US006625822B2

(12) United States Patent
De Sagarra Conde et al.

(10) Patent No.: US 6,625,822 B2
(45) Date of Patent: Sep. 30, 2003

(54) TOILET WITH A MODULAR VACUUM FLUSH SYSTEM

(75) Inventors: Miguel De Sagarra Conde, deceased, late of Valldoreix (ES); by Miguel De Segarra Romeo, executor, Granollers (ES)

(73) Assignee: Tecnicas Modulares E Industriales, S.A., Granollers (ES)

( * ) Notice: Subject to any disclaimer, the term of this patent is extended or adjusted under 35 U.S.C. 154(b) by 0 days.

(21) Appl. No.: 10/049,467

(22) PCT Filed: Jun. 8, 2001

(86) PCT No.: PCT/ES01/00236

§ 371 (c)(1),
(2), (4) Date: Aug. 12, 2002

(87) PCT Pub. No.: WO01/96677

PCT Pub. Date: Dec. 20, 2001

(65) Prior Publication Data

US 2003/0074728 A1 Apr. 24, 2003

(30) Foreign Application Priority Data

Jun. 12, 2000 (ES) ..... 20000156 U

(51) Int. Cl.[7] ..... E03D 11/00

(52) U.S. Cl. ..... 4/431; 4/420; 4/433

(58) Field of Search ..... 4/300, 316, 378, 4/420, 431–435, 458

(56) References Cited

U.S. PATENT DOCUMENTS 5,909,968 A * 6/1999 Olin et al. ..... 4/431

* cited by examiner

*Primary Examiner*—Tuan N. Nguyen
(74) *Attorney, Agent, or Firm*—Steinberg & Raskin, P.C.

(57) ABSTRACT

A toilet bowl (10), a tank (20) for the reception of a quantity of wastewater, a cut-off valve (12) between the bowl outlet and the tank inlet, a vacuum generator (22) connected to the tank (20), a tank inlet valve (23) for the inlet of pressurized air to the tank, a tank discharge valve (21), a plurality of electrically-operated valves and control means (4); these elements are grouped into at least a first module (1) which includes the toilet bowl (10) and the cut-off valve (12) at the outlet from the toilet bowl, a second module (2) which includes the tank (20), the vacuum generator (22), the tank inlet valve (23) for pressurized air and the tank discharge valve (21), and a third module (3) which includes said electrically-operated valves, and in that within each module the elements are joined together and have fixed connections between each other, while between one module and another there are fast-on hydraulic and pneumatic connections.

5 Claims, 3 Drawing Sheets

TOILET WITH A MODULAR VACUUM FLUSH SYSTEM

The present invention relates to a toilet with modular vacuum-disposal system which includes a toilet bowl, a tank for the reception of a quantity of wastewater, a cut-off valve between the bowl outlet and the tank inlet, a vacuum generator connected to the tank, a tank inlet valve for the inlet of pressurized air to the tank, a tank discharge valve, a plurality of electrically-operated valves and control means.

BACKGROUND OF THE INVENTION

Various types of vacuum-disposal toilets are known, for example for railways and the line. Such systems are generally installed at locations in which it is advisable to limit both the size and the consumption of the devices, and the design of the systems have been improving in this respect.

In particular, the toilets and their associated disposal systems have been made more compact, and a disposal system has been developed which has an intermediate wastewater tank associated with each toilet, inside which it is possible to cause selectively either a vacuum to suck in a charge of wastewater contained in the toilet, or a pressure higher than atmospheric pressure in order to expel the contents from the tank.

This partial vacuum and partial pressure design has reduced the consumption and size of the devices of the disposal system; however, especially while trying to make the systems more compact so that they occupy less space, assembly and maintenance have been made more difficult. For example, when one of the parts of the system has to be replaced or repaired, a large section of the assembly has to be disassembled, an operation which can take time, and it further requires that the maintenance personnel carry a high number of replacement parts.

In some cases, installation of the equipment is also a laborious operation, since the parts have to be fitted one after the other and all the connections made between them.

In the known compact systems which can be entirely factory-assembled before they are installed on the railway carriage or the like, installation is simplified, but the problem of maintenance is aggravated, because maintenance is either very complex or requires complete replacement of the equipment in the event of breakdown, the latter being a very costly solution.

DESCRIPTION OF THE INVENTION

The object of the present invention is to solve the mentioned drawbacks by developing a toilet with modular vacuum-disposal system which a compact and occupies a small space, while being at the same easy and inexpensive to assemble and maintain.

Another object is that the system can be adapted to the space available in each case, and that after installation it allows the addition of further modules, for example in order to increase its performance.

In accordance with these objectives, the toilet with vacuum-disposal system of this invention is characterised in that the aforesaid elements are grouped into at least a first module which includes the toilet bowl and the cut-off valve at the outlet from the toilet bowl, a second module which includes the tank, the vacuum generator, the tank inlet valve for pressurized air and the tank discharge valve, and a third module which includes said electrically-operated valves, and in that within each module the elements are joined together and have fixed connections between each other, while between one module and another there are fast-on hydraulic and pneumatic connections.

This modular system occupies a small space and at the same time allows simple and fast installation and maintenance operations. It thus solves the disadvantages mentioned in relation with installation and maintenance of the equipment, while it also presents other advantages, such as the ease with which the equipment can be extended after installation in order to improve its performance, and a remarkable improvement in industrialisation of the system, thanks to the possibility of manufacturing some basic modules and combining them in different ways according to the specific needs of each case.

The modularity of the equipment also facilitates the incorporation of additional functions, such as an anti-freeze module, in cases where such are necessary.

In a preferred embodiment, the equipment further includes a fourth module, made up of all the control elements, and a fifth module which includes a pump for discharge of cleaning water to the toilet bowl.

Preferably, each module also includes at least some of the accessory elements of its components.

In accordance with one aspect of the invention, the second module is mounted on a supporting frame which is attached in a suitable location, and the first module is mounted on the second module by means of two side supports, the toilet bowl being mounted adjacent to the tank.

Thus, the module with the bowl and its outlet valve, which is one of the most prone to fail, can be easily removed for replacement.

BRIEF DESCRIPTION OF THE DRAWINGS

For a better understanding of all that has been outlined some drawings are attached which, schematically and solely by way of non-restrictive example, show a practical case of embodiment.

In said drawings.

DESCRIPTION OF A PREFERRED EMBODIMENT

Figure 1:
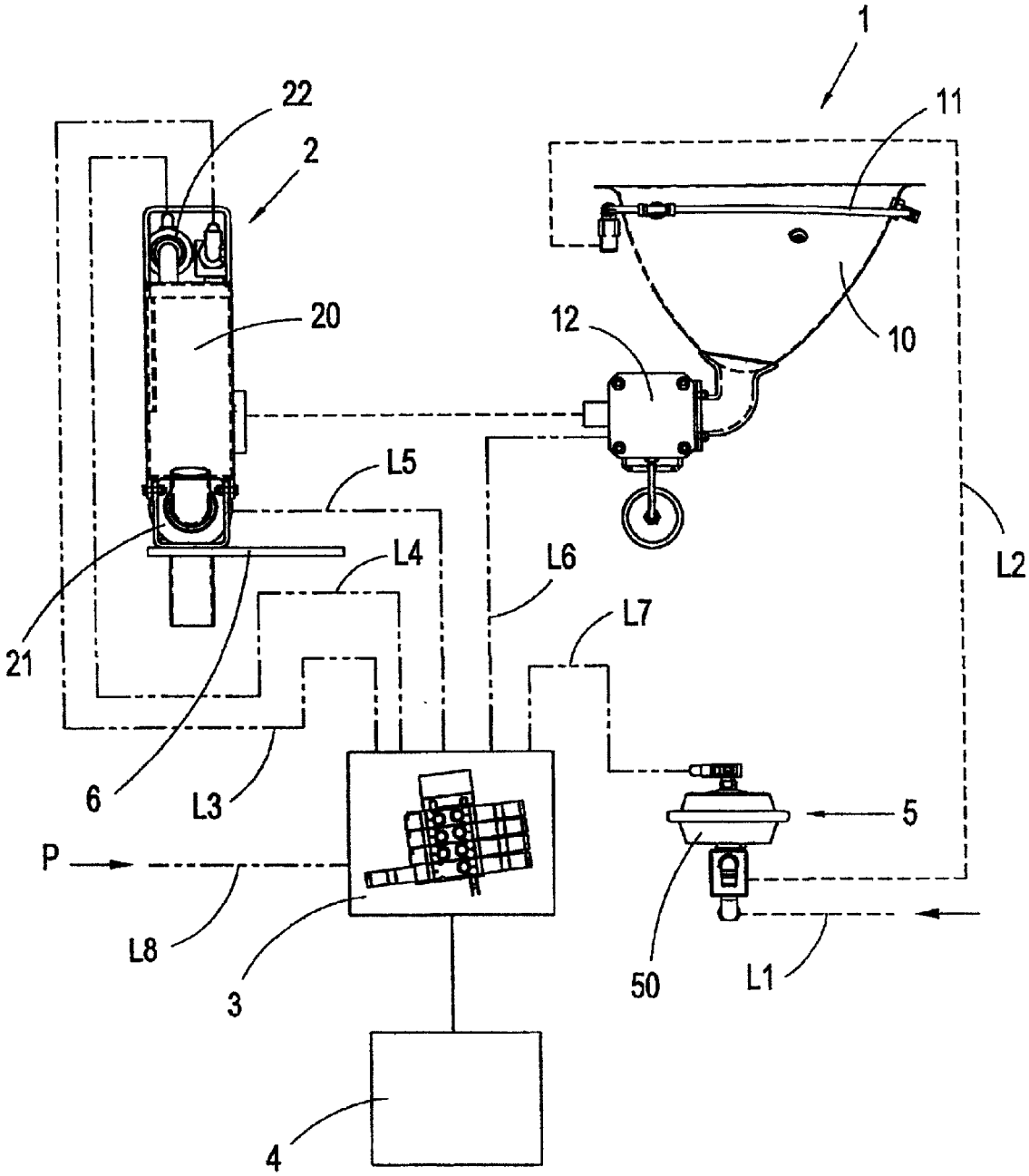
FIG. 1 is a schematic view of a toilet with modular vacuum-disposal system in accordance with the invention, with its parts separated.

FIG. 1 illustrates schematically the main elements of the toilet system of the invention and the connections between them.

The system comprises: a first module 1 which includes the toilet bowl 10, a cleaning water supply system 11, a valve 12 associated with the outlet from the bowl, and its accessories; a second module 2 made up of a tank 20, its discharge valve 21 and the vacuum generating ejector 22, for creating a vacuum in the tank in order to carry the contents of the toilet bowl towards the tank; a pneumatic module 3, which includes a number of electrically-operated valves for driving the various elements; a control module 4, which contains all the electrical and electronic controls of the system; and a pump module 5, consisting in the pump 50 which discharges the cleaning water into the bowl and its associated accessories.

The tank 20 has a capacity of about 5 liters (although this characteristic is not restrictive), and it constitutes an intermediate tank between the bowl and a larger tank (not shown) which can be connected to several toilets, in such a way that the tank 20 is emptied at intervals and the wastewater goes on to the final tank.

The pumping module 5 is not a part of the disposal system as such, but it is advisable also to integrate it into the installation; it is also connected to the pneumatic module 4 and is housed physically adjacent to the other modules.

The toilet includes a base frame 6 to which is fixed the intermediate tank module 2; on the latter are mounted the other modules of the system, using for example brackets, flanges and bolts.

As shown schematically in FIG. 1, the various modules are connected to each other by means of suitable pipes: the pump 50 is connected through respective water pipes L1 and L2 to the water network (not shown) and to the system 11 of water supply to the toilet bowl; the bowl outlet valve 12, once the system has keen fitted, is connected directly to the tank inlet 20; and the electrically-operated valves of the pneumatic module 3 are connected through pneumatic lines L3 to L7 to the various elements they have to actuate. The module 3 is connected through a line L8 to a source of air under pressure.

All the couplings between the various elements, both pneumatic and hydraulic, are implemented with fast-on connections, that is, snap-on connections or the like.

In its turn, the control module 4 has cables for connection to the electrically-operated valves of module 3, to auxiliary elements of the system, such as sensors and the like, and to the button for actuating discharge of water into the toilet bowl. These electrical connections are conventional and have not been shows, in order to avoid complications in the figure.

Figure 2:
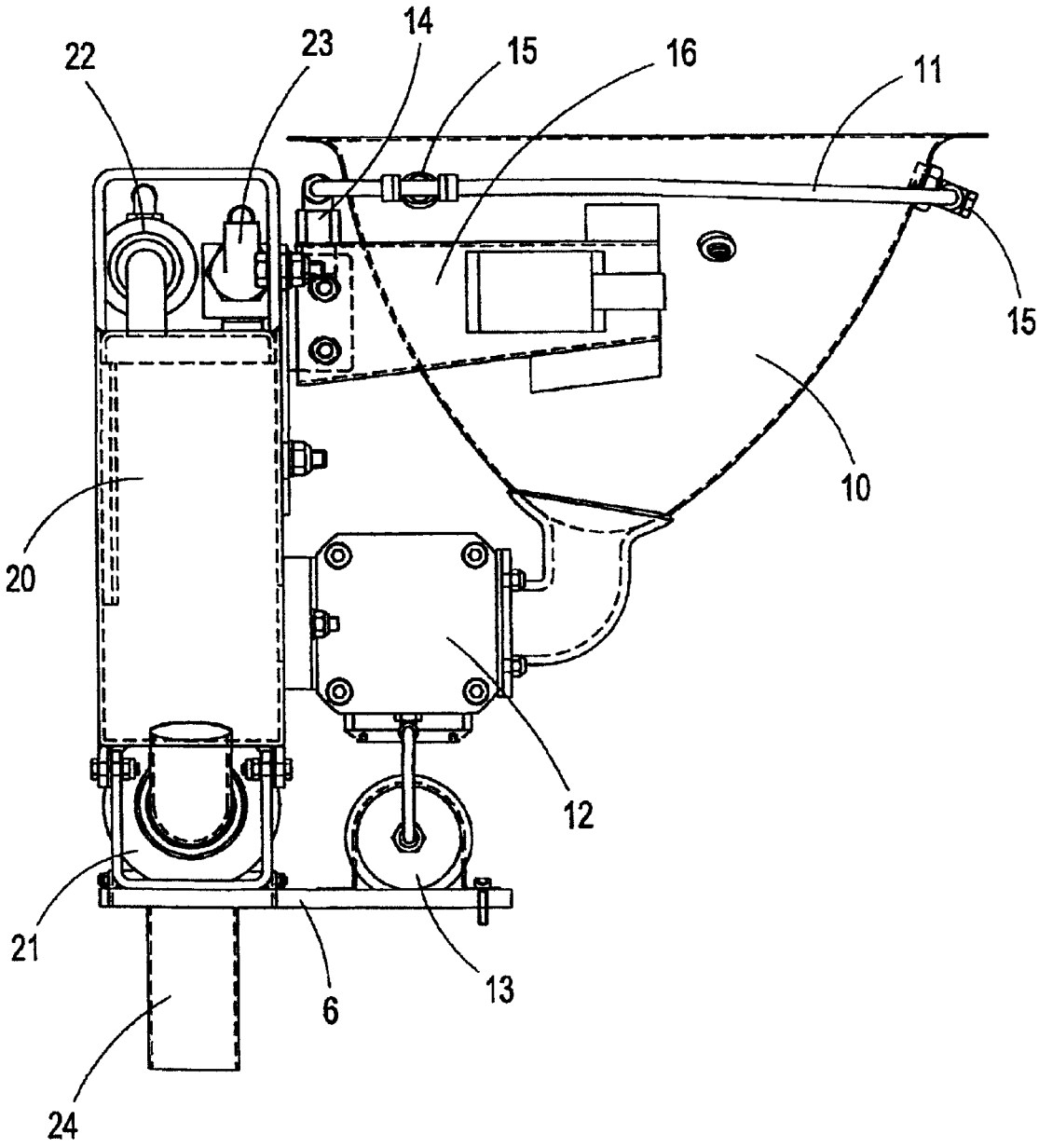
FIG. 2 is a side elevation view of the system of FIG. 1, with some modules assembled.

FIG. 2 shows the system with the two main modules fitted.

Module 1 includes, in addition to the toilet bowl 10 and the cut-off valve 12 for opening and closing passage of wastewater from the bowl 10 to the tank 20, a lubricator 13. The valve 12 includes a corresponding actuator (not visible in the figure, since it is behind the valve itself) connected to the pneumatic module 3. The cleaning water feed pipe 11 is installed at the upper part of the bowl, forming part of module 1. It has a fast-on connection 14 to line L2 for attachment to the pump 50, and branch lines 15 for supplying water to various points of the bowl.

Figure 3:
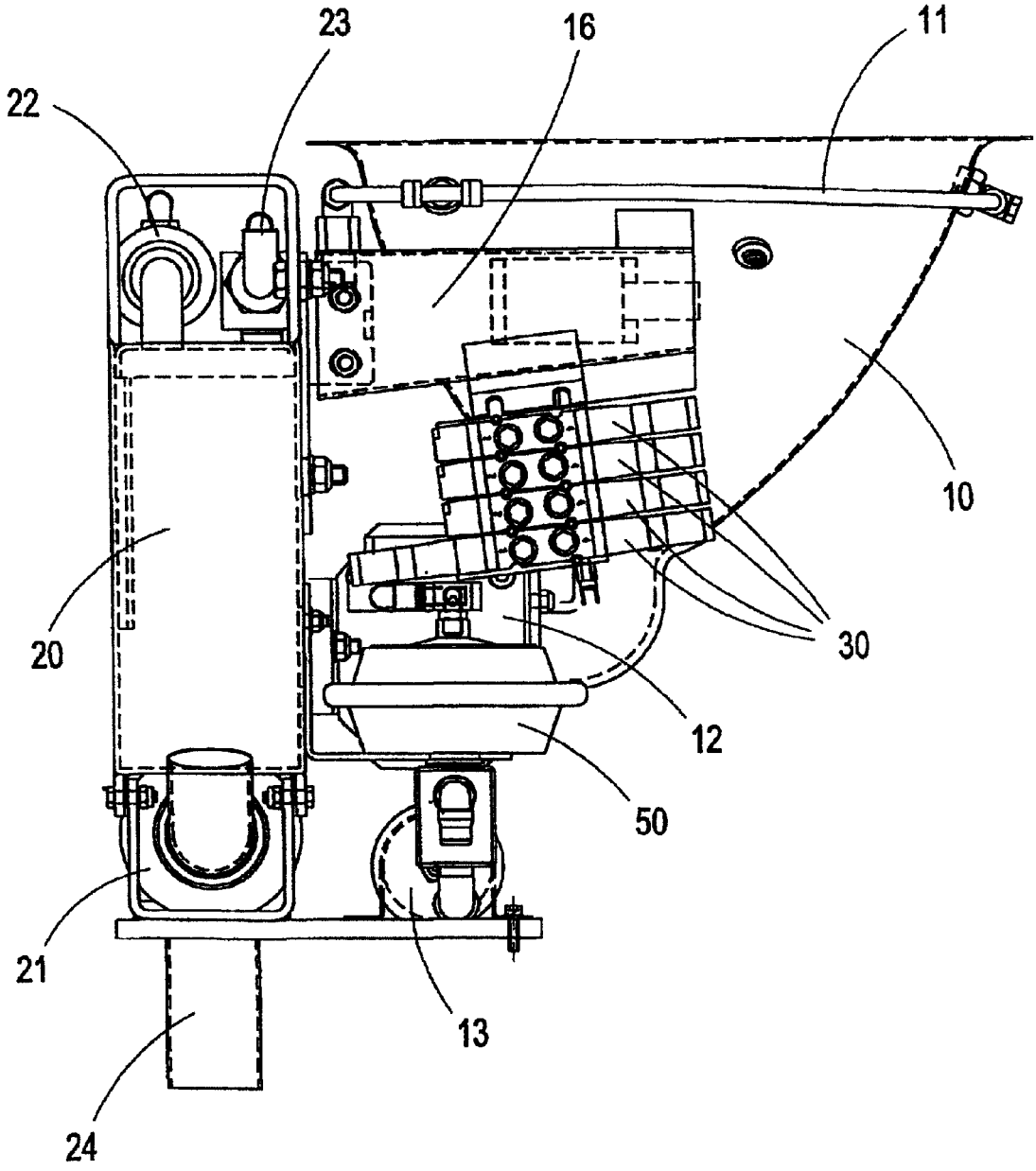
FIG. 3 is a view similar to that of FIG. 2, to which the pneumatic module and the water pump module have been added.

Module 1 is attached on module 2 of the tank through side supports 16, one of which is visible in FIGS. 2 and 3.

Module 2 with the intermediate tank 20, which is mounted on the supporting frame 6, also includes the ejector 22, a pressurized-air inlet valve 23, with which are associated a sensor and pressure regulator, and a discharge valve 21 for draining the tank 20.

The ejector 22 and the inlet valve 23 are mounted on the tank 20, while the cut-off valve 21 is connected at the lower part thereof. The outlet pipe 24 from the valve 21 is connected to a discharge pipe leading to another tank (not shown) of larger capacity, to which several toilets can be connected.

The function of the ejector 22 is to create a temporary vacuum in the tank, synchronised with the opening of the valve 12 and with the discharge of cleaning water into the toilet bowl, for the purpose of carrying the wastewater from the bowl to the tank.

The function of the pressurized-air inlet valve 23 is to allow the entry of air under pressure into the tank 20, in synchronisation with opening of the discharge valve 21, in order to drain the tank 20. The pressure regulator associated with the valve 23 limits the pressure in the tank to a predetermined value, such as 2 bar.

FIG. 3 shows the toilet with all modules fitted to the system, except for the control module 4, which would normally be installed separately from the toilet.

As can be seen in this figure, in the embodiment shown the pneumatic module 3 and the pump module 5 are mounted one on top of the other, on one side of the toilet bowl 10.

The modular toilet described is mounted onto a railway carriage using the pre-assembled modules described. Firstly, module 2 of the tank is installed, and then module 1 of the bowl 10 is mounted on top of it, followed by the pump module 5 and the pneumatic module 3. The modules are attached using supports and bolted fittings easy to access.

Finally, all the connections between the different modules are made by means of pipes and fast-on connectors of known type.

If it is wished to include additional accessories, such as higher-performance components, control programs with more features, maintenance management programs, communication with a central computer, or a component to prevent freezing, then the modular nature of the system makes such additions easier.

The operation of the system is as follows. When a user presses the cleaning water discharge (flush) button, the pump 50 pumps water to the bowl through the feed pipe 11; at the same time, the bowl outlet valve 12 opens and the ejector 22 actuates to create a depression in the tank in order to "suck" the wastewater from the bowl into the tank. At the end of the operation, the ejector stops and the valve 12 closes again.

Next, in a separate operation, the tank 20 is drained. To that end, with the valve 12 closed, the discharge valve 21 is opened and pressure is provided to the tank through the air inlet valve 23.

The entire process is governed by the control means 4, on the basis of programming parameters and reading of suitable sensors.

In the event of a fault in one of the modules, and if the fault calls for more than elementary work, it is quick and easy to disconnect the pipes associated with that module, remove it and fit a new module in its place.

Although one specific embodiment of this invention has been described and shown, it will be obvious that an expert in the subject would be able to make changes and modifications, or replace details by others that are technically equivalent, without departing from the scope of protection defined by the appended claims.

For example, it should be taken into account that the system includes other conventional elements, which have not been shown in order to avoid complicating the drawings, and which could be associated physically with any of the modules described.

What is claimed is:

1. A toilet with modular vacuum-disposal system, which includes a toilet bowl (10), a tank (20) for the reception of a quantity of wastewater, a cut-off valve (12) between the bowl outlet and the tank inlet, a vacuum generator (22) connected to the tank (20), a tank inlet valve (23) for the inlet of pressurized air to the tank, a tank discharge valve (21), a plurality of electrically-operated valves and control means (4), characterized in that the aforesaid elements are grouped into at least a first module (1) which includes the toilet bowl (10) and the cut-off valve (12) at the outlet from the toilet bowl, a second module (2) which includes the tank (20), the vacuum generator (22), the tank inlet valve (23) for pressurized air and the tank discharge valve (21), and a third module (3) which includes said electrically-operated valves, and in that within each module the elements are joined together and have fixed connections between each other, while between one module and another there are fast-on hydraulic and pneumatic connection.

2. A toilet as claimed in claim 1, characterized in that it further includes a fourth module (4), made up of all the control elements.

3. A toilet as claimed in claim 1, characterized in that it further includes a fifth module (5) which includes a pump (50) for discharge of cleaning water to the toilet bowl (10).

4. A toilet as claimed in claim 1, characterized in that each module (1, 2, 3, 4, 5) also includes at least some of the accessory elements of its components.

5. A toilet as claimed in claim 1, characterized in that the second module (2) is mounted on a supporting frame (6) which is attached in a suitable location, and the first module (1) is mounted on the second module (2) by means of two side supports (16), the toilet bowl (10) being mounted adjacent to the tank (20).

* * * * *

UNITED STATES PATENT AND TRADEMARK OFFICE

CERTIFICATE OF CORRECTION

PATENT NO. : 6,625,822 B2
DATED : September 30. 2003
INVENTOR(S) : De Sagarra Conde et al.

It is certified that error appears in the above-identified patent and that said Letters Patent is hereby corrected as shown below:

Title page,
Item [75], Inventors, "Segarra" should read -- Sagarra --.
Item [30], Foreign Application Priority Data, "20000156" should read -- 200001568 --.

Signed and Sealed this

Thirteenth Day of December, 2005

JON W. DUDAS
*Director of the United States Patent and Trademark Office*